United States Patent [19]

Murdock

[11] 4,000,883

[45] Jan. 4, 1977

[54] RAILING CONSTRUCTION

[75] Inventor: Robert H. Murdock, Kensington, Calif.

[73] Assignee: NEF Systems, Richmond, Calif.

[22] Filed: Oct. 1, 1975

[21] Appl. No.: 618,566

[52] U.S. Cl. ..... 256/65; 256/73; 248/251

[51] Int. Cl.[2] ..... E04H 17/14

[58] Field of Search ..... 265/65–73, 265/59; 248/251; 403/196, 234, 256, 409, 232, 187, 199, 241, 189

[56] References Cited

UNITED STATES PATENTS 3,005,623 10/1961 Kusel et al. ..... 256/65

FOREIGN PATENTS OR APPLICATIONS 20,230 11/1898 United Kingdom ..... 256/65

*Primary Examiner*—Werner H. Schroeder
*Assistant Examiner*—Doris L. Troutman
*Attorney, Agent, or Firm*—Harris Zimmerman

[57] ABSTRACT

A railing construction comprises a laterally disposed sub rail member which supports a top rail, and a support bracket at either end of the sub rail for securing the sub rail to a wall or post. The bracket includes a generally vertically disposed member which is provided with a bolt hole through the upper end thereof. A pair of generally parallel web members extend normally from the lower end of the vertical member, the lower web member extending farther outward and including an obliquely upwardly extending flange at the distal end thereof. The slot between the two web members is adapted to receive the sub rail therein only when the bracket is canted downwardly toward the sub rail. As a bolt passed through the bolt hole is tightened into a wall or post, the canted bracket approaches vertical, and the flange and the lower surface of the upper web lever the sub rail into rigid engagement.

7 Claims, 5 Drawing Figures

RAILING CONSTRUCTION

BACKGROUND OF THE INVENTION

There are many systems known in the prior art for constructing prefabricated railings and the like. These constructions generally comprise a sub rail which supports a top, or finishing rail, vertical bars or pickets which are secured to the sub rail, and brackets which secure the sub rail to walls or posts. Although the basic design consideration for these railing systems is to minimize the amount of field preparation for the various parts, experience has shown that extensive field work is often required. For example, this is often the case when the prefabricated parts which are orthogonal must be adapted to walls which are not plumb or which are canted.

It is often found that the actual wall spacing varies from the nominal design dimensions, and thus from the dimensions of the precut railing parts. In such case the railing must be modified at the job site to accommodate the actual wall spacing. Often spacer blocks must be used, or the mounting bracket and sub rail must be re-drilled to provide the correct spacing. This field modification is expensive and time consuming.

SUMMARY OF THE INVENTION

The present invention generally comprises a prefabricated railing assembly which includes wall mounting brackets capable of accommodating variations in wall spacing from the design dimensions. The bracket retains the sub rail of the railing assembly in a resilient manner which will not loosen or rattle, and which also allows thermal expansion of the sub rail.

The bracket includes a pair of parallel web members which are spaced apart vertically and secured at one end to a vertical plate member. The lower web member includes a flange extending obliquely upwardly from the distal end thereof. The spacing of the flange and the upper web member is such that the end of the sub rail may be freely received therebetween only when the bracket is canted obliquely downwardly toward the sub rail.

The vertical plate member is provided with a bolt hole in the upper portion thereof, through which a bolt extends into an expansion shield or the like in the wall. Due to the cant of the bracket when engaging the sub rail, the upper end of the vertical plate member is spaced apart from the wall. As the bolt is threaded into the expansion shield, the vertical plate member approaches vertical, and the flange and the upper web member apply a torque to the end of the sub rail. This manner of engagement permits a certain amount of latitude in the spacing of the end of the sub rail from the wall mounting bracket. Further, the resilient engagement allows thermal expansion of the sub rail to take place, while providing a rigid mounting which is capable of withstanding high shock and stress loads.

THE DRAWING

DESCRIPTION OF THE PREFERRED EMBODIMENT

Figure 1:
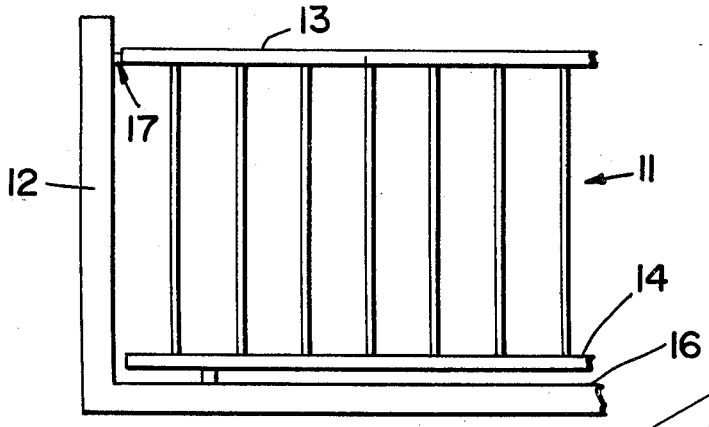
FIG. 1 is a plan view of the railing assembly of the present invention.

As shown in FIG. 1, the present invention generally comprises a railing assembly 11 adapted to be secured at at least one end to a wall 12 or similar vertical structural member. The railing assembly generally includes a top rail 13 and a bottom rail 14, with a plurality of vertical bars or pickets extending therebetween. The bottom rail 14 is secured to the floor 16, or to a balcony deck or the like. The top rail is joined to the wall 12.

Figure 2:
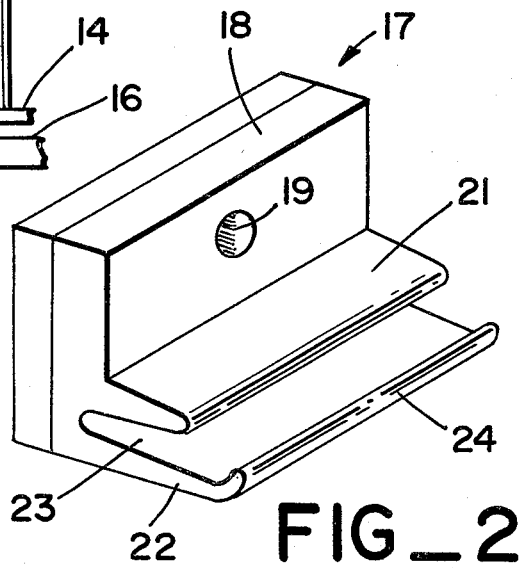
FIG. 2 is a perspective view of the wall mounting bracket of the present invention.

As shown in FIG. 2, the wall mounting bracket 17 for joining the top rail to the wall 12 includes a vertical plate member 18 which is provided with a bolt hole 19 through the upper end thereof. Extending from the lower end of the vertical plate member are a pair of vertically stacked, horizontal web members 21 and 22. The lower web 22 extends farther than the upper web 21, and the two web members define therebetween a slot 23 which extends partially into the vertical plate member 18. Joined to the distal edge of the lower web member 22 and extending obliquely upward therefrom is a curved flange 24.

Figure 5:
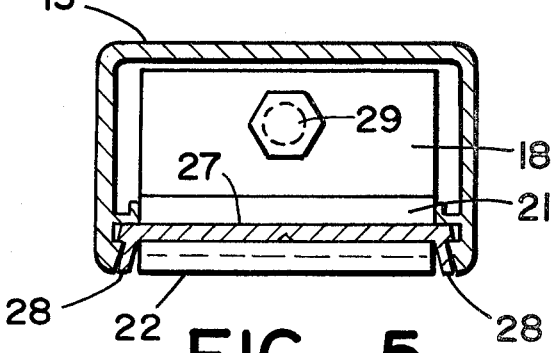
FIG. 5 is a cross-sectional elevation of the railing assembly of the present invention, taken along line 5—5 of FIG. 4.

As shown in FIG. 5, the top rail 13, which is a box rail, is resiliently secured to and supported by a sub rail 26. The sub rail includes a laterally extending web 27, and a pair of opposed flanges 28 extending subjacently therefrom. The flanges diverge slightly to engage the opposed edges of the box rail.

Figure 3:
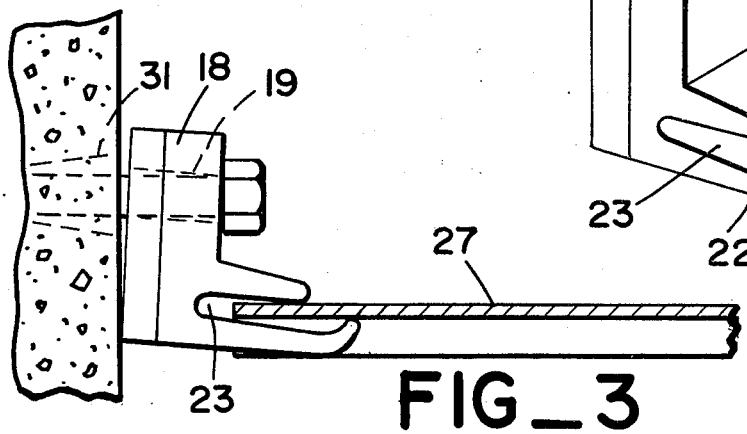
FIG. 3 is a cross-sectional elevation of the wall bracket assembly, shown loosely joined to a wall.

The lower web member 22 of the wall bracket is sufficiently narrow to be received between the opposed flanges 28 of the sub rail. The web 27 of the sub rail may thus be inserted into the slot 23 of the wall bracket. Due to the presence of the flange 24 and the spacing of the web members 21 and 22, this can only be accomplished by canting the wall bracket downwardly, as shown in FIG. 3. A bolt 29 is then inserted through the hole 19 into an expansion shield 31 or other anchoring device which is disposed permanently in the wall 12.

Figure 4:
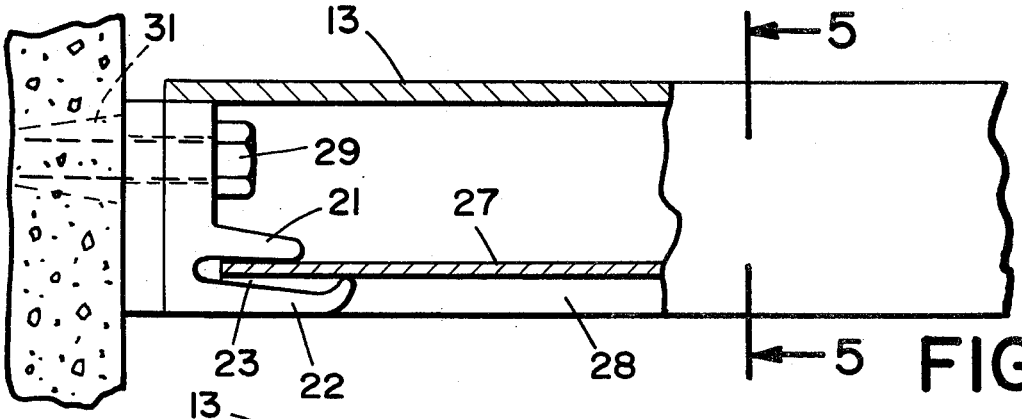
FIG. 4 is a cross-sectional elevation of the wall bracket assembly completely assembled to a wall, with the top rail snappingly joined to the sub rail.

As the bolt is tightened into the expansion shield (FIG. 4), the bracket is forced to assume a vertical disposition with the vertical plate member flush with the wall 12. The distal edge of the flange 24 and the undersurface of the upper web member 21 resiliently apply a torque to the web 27 of the sub rail, binding the sub rail in the slot 23. This binding engagement is capable of withstanding heavy shock and stress loads, yet will permit thermal expansion of the sub rail.

After the wall bracket is assembled to the wall, the top rail is snappingly joined to the sub rail, completing the assembly of the railing. It may be appreciated that this method of assembly involves a minimum of time and labor. Furthermore, the manner of engagement of the bracket and the sub rail allows for variations in spacing of the wall and the end of the sub rail, as well as angular variations due to walls which are canted or out of plumb. Also, in the final assembly the lower edges of the top rail, the flanges 28, and the web member 22 are all flush, providing a handsome, finished appearance.

I claim:

1. A railing assembly comprising a rail member having a laterally extending web portion and a mounting bracket for engaging said web portion and securing said rail member to a structural member, said mounting bracket including a lateral slot for receiving said web portion, and securance means for securing said mounting bracket to said structural member with said lateral slot aligned obliquely with respect to said web portion for binding engagement thereof.

2. The railing assembly of claim 1, wherein said mounting bracket includes a pair of vertically stacked web members extending therefrom and defining said lateral slot therebetween.

3. The railing assembly of claim 2, wherein said mounting bracket includes a vertical plate member from which said web members extend.

4. The railing assembly of claim 3, wherein said slot is oriented non-orthogonally with respect to said vertical plate member.

5. The railing assembly of claim 3, wherein the lower one of said web members is provided with an upwardly extending flange joined to a distal portion thereof.

6. The railing assembly of claim 4, wherein said vertical plate member is secured flush with said structural member and said slot bindingly engages said web portion of said rail member.

7. The railing assembly of claim 5, wherein said flange impinges on the lower surface of said web portion of said rail member at a first point, and the lower surface of said upper web member impinges on the upper surface of said web portion of said rail member at a second point, said first and second points being laterally spaced so that said web portion is resiliently bound in said slot by the torque applied between said first and second points.

* * * * *